US009076610B2

(12) United States Patent
Murzyn et al.

(10) Patent No.: US 9,076,610 B2
(45) Date of Patent: Jul. 7, 2015

(54) ROTARY KNOB ASSEMBLY

(71) Applicants: Pawel Murzyn, Chelmsford (GB); Metin Soenmez, Erkelenz (DE)

(72) Inventors: Pawel Murzyn, Chelmsford (GB); Metin Soenmez, Erkelenz (DE)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 14/101,535

(22) Filed: Dec. 10, 2013

(65) Prior Publication Data

US 2015/0162148 A1 Jun. 11, 2015

(51) Int. Cl.
*H01H 25/00* (2006.01)

(52) U.S. Cl.
CPC ..... *H01H 25/008* (2013.01); *H01H 2219/0622* (2013.01); *H01H 2219/036* (2013.01); *H01H 2221/01* (2013.01); *H01H 2231/016* (2013.01)

(58) Field of Classification Search
CPC ..... H01H 19/025; G01D 11/28; G05G 1/105
USPC ..... 362/23.01, 23.1, 23.09
See application file for complete search history.

(56) References Cited

U.S. PATENT DOCUMENTS

| | | | | |
|---|---|---|---|---|
| 5,093,764 | A * | 3/1992 | Hasegawa et al. | 362/29 |
| 5,359,165 | A | 10/1994 | Leveque et al. | |
| 6,356,394 | B1 | 3/2002 | Glienicke | |
| 2007/0253185 | A1 | 11/2007 | Palacio | |
| 2013/0229783 | A1 | 9/2013 | Fendeleur et al. | |

* cited by examiner

*Primary Examiner* — Anabel Ton
(74) *Attorney, Agent, or Firm* — Dickinson Wright PLLC

(57) ABSTRACT

A rotary knob assembly having a lightpipe affixed to a push button within a rotary knob portion that may be rotatably affixed to a vehicle control panel. The lightpipe engages a halo ring surrounding the push button and is disposed between the push button and the rotary knob portion. The lightpipe has a plurality of concentric circles recessively disposed thereon to provide illumination to the knob assembly specifically, to the halo ring and a graphic display of the push button. The rotary knob assembly has a first light emitting diode in communication with the control panel to provide light to the lightpipe. Light is transmitted and refracted through the lightpipe illuminating the halo ring surrounding the push button as well as distributes light to the recessed portion or gaps between the plurality of concentric circles which allow light to flow directly to the graphic display of the push button.

20 Claims, 4 Drawing Sheets

ROTARY KNOB ASSEMBLY

TECHNICAL FIELD

The present disclosure relates generally to the illumination of a rotary knob assembly for a control panel, and in particular to a lightpipe having a plurality of concentric surfaces that allows light to be emitted therefrom.

BACKGROUND

Rotary knob assemblies utilized within a vehicle control panel for adjusting vehicle settings such as a temperature controller are well-known. Typically, the assemblies use equipment which illuminates the knob either to show the setting is ON or to visually indicate to the user the parameters of the setting.

Rotary knob assemblies are generally equipped with many components such as multiple lightpipes and multiple light emitting diodes to sufficiently illuminate the knob. These components have been assembled in a variety of configurations. In one known example, the multiple light emitting diodes and multiple lightpipes have been located both within and outside the knob assembly. In another known example, the light emitting diodes and multiple lightpipes have been located entirely within the assembly to illuminate certain portions of the knob. Alternatively, the light emitting diodes and multiple lightpipes have also been located outside the assembly to illuminate certain portions of the knob. However, all these examples of different configurations utilize a multitude of components and occupy a large volume of space on the control panel. The configurations are thus undesirable to both users and manufacturers. Additionally, the use of multiple light emitting diodes requires significant energy use within the control panel. Accordingly, there is a need for a rotary knob assembly that is compact and utilizes less energy.

SUMMARY

A rotary knob assembly for a vehicle control panel is provided.

According to one aspect, the rotary knob assembly is part of a vehicle control panel and includes a lightpipe in communication with a push button disposed within a rotary knob portion of the rotary knob assembly. The lightpipe also includes a peripheral portion that engages a halo ring disposed between the push button and the rotary knob portion. The lightpipe also includes a plurality of concentric circles recessively disposed on the middle portion thereof, the concentric circles generally define a central axis of the lightpipe. The rotary knob assembly further includes a first light emitting diode (LED) in communication with a middle portion to emit light to the lightpipe. The light from the first LED is refracted through the lightpipe and is distributed through the plurality of concentric circles to illuminate to a graphic display of the push button and to the peripheral portion to illuminate the halo ring.

Another aspect of the rotary knob assembly includes a lightpipe having a generally cylindrical shape. The lightpipe is in communication with an inner surface of a push button within a rotary knob portion of a vehicle control panel. The lightpipe also includes a peripheral portion that engages a halo ring. The lightpipe, the push button, and the halo ring remain stationary when the rotary knob portion rotates. The lightpipe further includes a plurality of concentric circles defining a central axis. The rotary knob assembly further includes a first LED which emits light to the middle portion of the lightpipe. The light from the first LED is refracted through the lightpipe and is distributed through the plurality of concentric circles to illuminate a graphic display of the push button and to the peripheral portion to illuminate the halo ring.

The aspects disclosed herein provide various advantages. For instance, the rotary knob assembly may be compact compared to conventional rotary knob assemblies through the utilization of one lightpipe and one LED to illuminate both the halo ring and the graphic display of the push button. Additionally, the rotary knob assembly disclosed herein may be more energy efficient than conventional knob assemblies due to the utilization of one LED to illuminate both the halo ring and the graphic display of the push button.

BRIEF DESCRIPTION OF THE DRAWINGS

Other aspects of the present disclosure will be readily appreciated, as the same becomes better understood by reference to the following detailed description when considered in connection with the accompanying drawings wherein.

DETAILED DESCRIPTION OF THE ENABLING EMBODIMENTS

Detailed examples of the present disclosure are disclosed herein; however, it is to be understood that the disclosed examples are merely exemplary and may be embodied in various and alternative forms. It is not intended that these examples illustrate and describe all possible forms of the disclosure. Rather, the words used in the specification are words of description rather than limitation, and it is understood that various changes may be made without departing from the spirit and scope of the disclosure.

The aspects disclosed herein provide a rotary knob assembly including a lightpipe. The lightpipe has a middle portion and a peripheral flange. The middle portion may be affixed to a push button that is disposed in a middle of a rotary knob portion of a rotary knob assembly. According to another aspect, the peripheral flange of the lightpipe can engage a halo ring surrounding the push button. Additionally, the lightpipe may have a plurality of concentric circles formed on the middle portion that are recessively disposed on a surface thereof and which define a central axis of the lightpipe to provide illumination to a graphic display of the knob assembly. It will be appreciated that the lightpipe may have a variety of other configurations.

Figure 1:
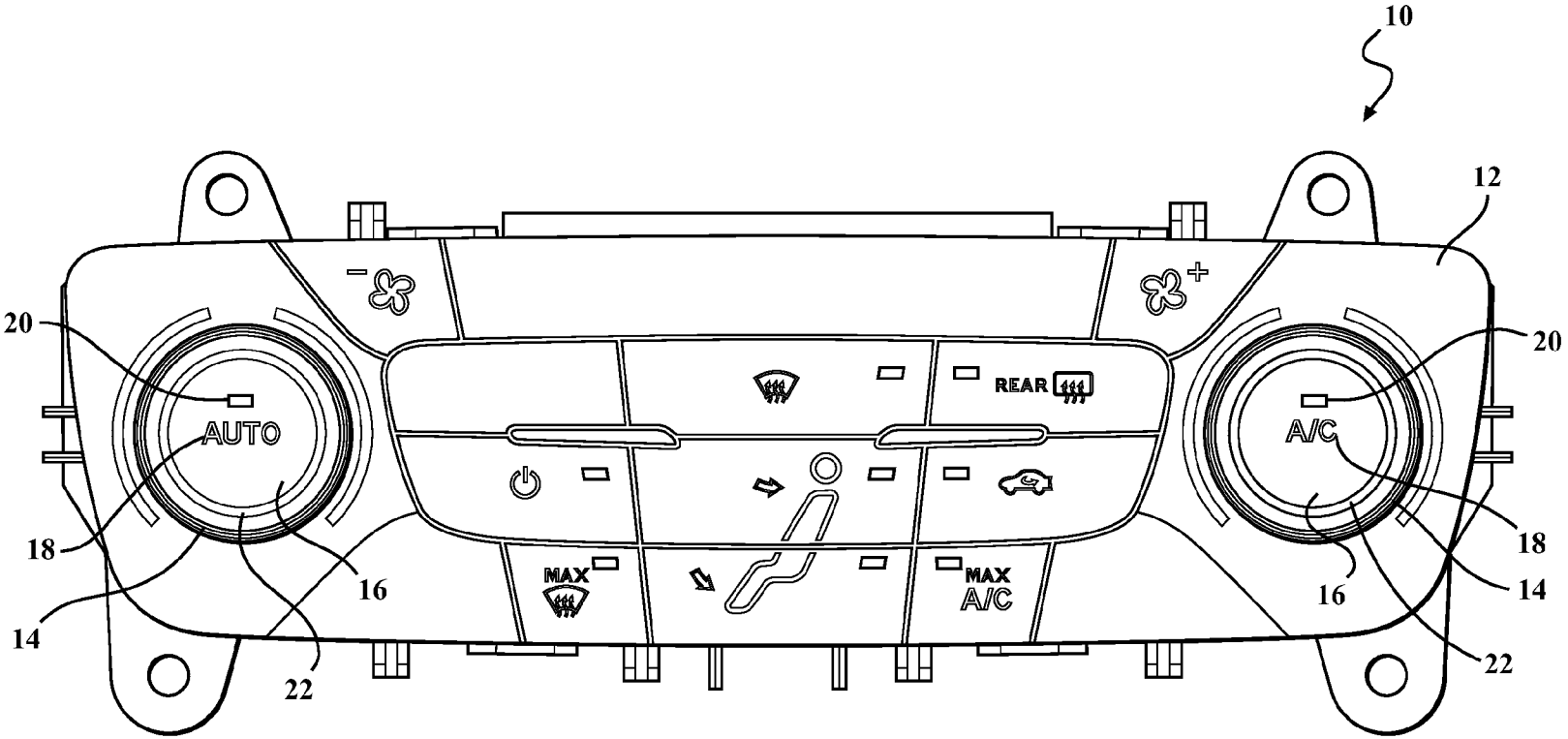
FIG. 1 is a schematic illustration of a control panel having a plurality of rotary knob assemblies in accordance with an aspect of the disclosure.

FIG. 1 is an illustration of an assembly control panel 12 having a plurality of rotary knob assemblies 10 in accordance with an aspect of the disclosure. The rotary knob assemblies 10 include a rotary knob portion 14 rotatably affixed to the control panel 12, a push button 16 disposed within the rotary knob portion 14, and a halo ring 22 surrounding the push button 16 and radially disposed between the push button 16 and the rotary knob portion 14.

The push button 16 can have a graphic display 18. As shown in FIG. 1, the graphic display 18 may display the "A/C" or "AUTO" setting of the vehicle control panel 14. Other settings or lettering may be displayed on the graphic display 18 such as, but not limited to, volume, heat, heated seats, or a telephone. Additionally, the push button 16 may have an indicator light 20 therein. The indicator light 20 can inform the user of the vehicle of certain information including that a certain setting is turned ON or OFF. In FIG. 1, the indicator light 20 is shown above the graphic display 18. However, the indicator light 20 is not limited to the location above the graphic display 18 and may instead be located adjacent to the graphic display 18 or in a variety of other suitable locations.

As those of ordinary skill in the art will understand, various features of the present disclosure as illustrated and described with reference to any of the Figures may be combined with features illustrated in one or more other Figures to produce examples of the present disclosure that are not explicitly illustrated or described. The combinations of features illustrated provide representative examples for typical applications. However, various combinations and modifications of the features consistent with the teachings of the present disclosure may be desired for particular applications or implementations.

Figure 2B:
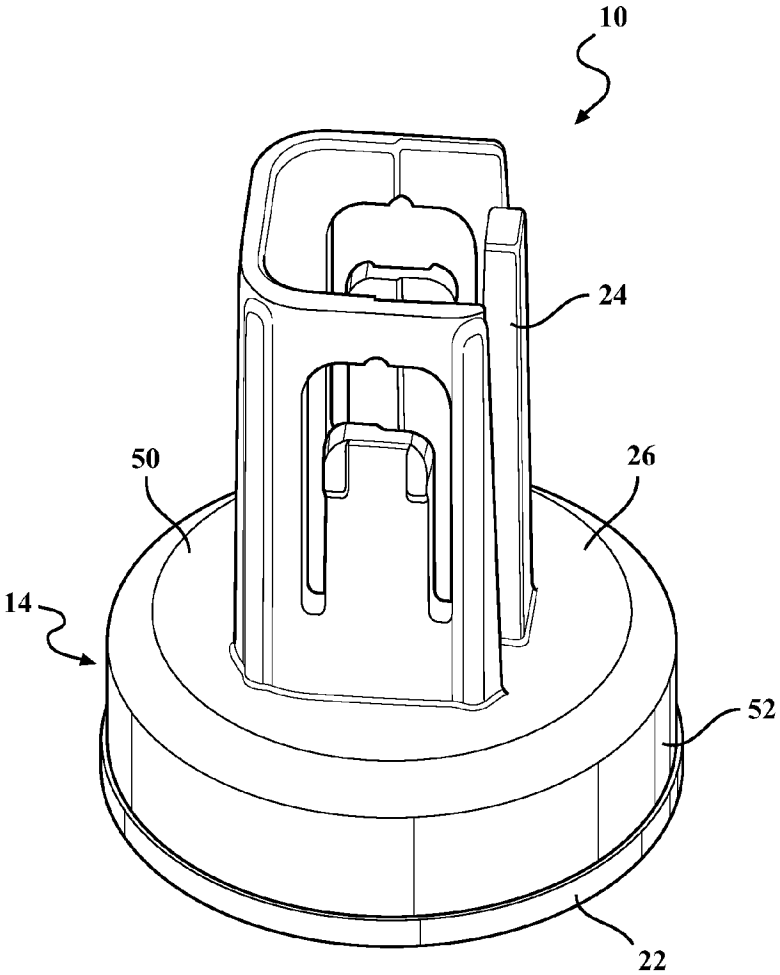
FIGS. 2A and 2B are perspective views of a rotary knob assembly in accordance with an aspect of the disclosure.
Figure 2A:
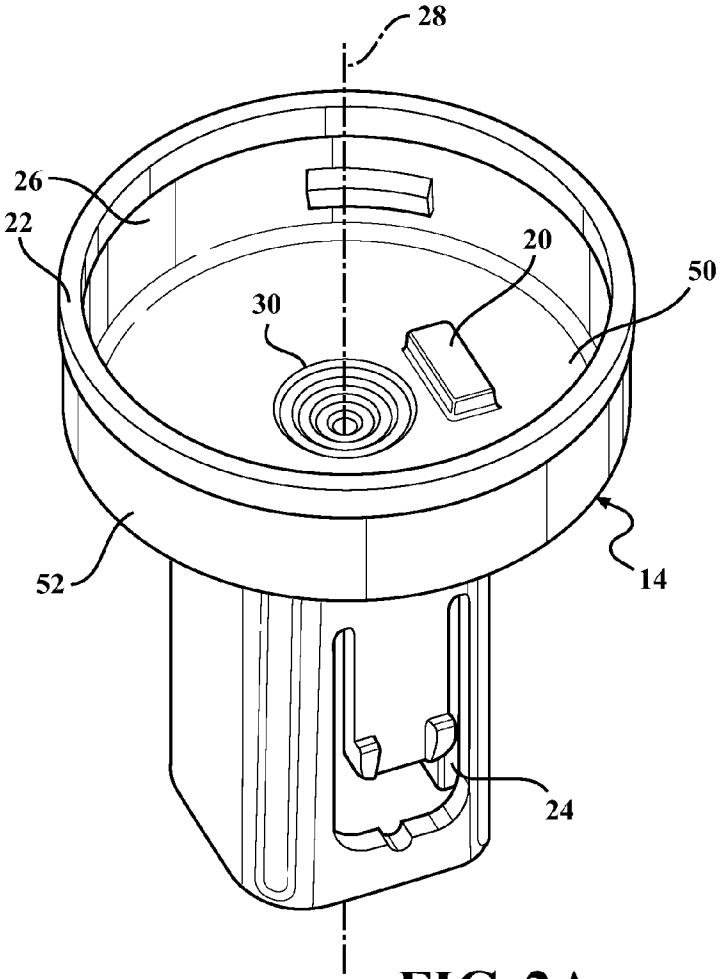

FIGS. 2A and 2B are perspective views of a rotary knob assembly 10 in accordance with an aspect of the disclosure. According to an aspect, the rotary knob assembly 10 may include a lightpipe 26. With specific reference to FIG. 3, the lightpipe 26 may include a middle portion 50 and a peripheral flange 52. The middle portion 50 of the lightpipe 26 may be affixed to the inner surface of the push button 16 (not shown) disposed within the rotary knob portion 14 of a vehicle control panel 12. Specifically, the inner surface of the push button 16 may have a biased portion 54 or peg which engages a groove within the peripheral flange 52 of the lightpipe 26 and locks the lightpipe 26 into place. The peripheral flange 52 of the lightpipe 26 can also engage a halo ring 22 which surrounds the push button 16 and is radially disposed between the push button 16 and the rotary knob portion 14. The lightpipe 26 may have, but is not limited to a cylindrical shape. The lightpipe 26 alternatively may have a frustoconical shape, a u-shape, a t-shape, or may have a generally lateral shape. According to an aspect, the lightpipe 26 may further include a plurality of concentric circles 30 recessively disposed on the middle portion 50 thereof. The plurality of concentric circles 30 may generally define a central axis 28 of the lightpipe 26. Alternatively, the plurality of concentric circles 30 and the axis 28 may also be located along other portions of the lightpipe 26.

A first light emitting diode (LED) 32 (not shown) may also be disposed on the control panel 12 within the rotary knob portion 14. The first LED 32 can emit light directly to the middle portion 50 of lightpipe 26. The light may be refracted through the lightpipe 26 to the middle portion 50 to illuminate the halo ring 22. Also, the light may be distributed directly through the plurality of concentric circles 30 to illuminate the graphic display 18 on the push button 16. Specifically, the recessed portions or gaps between the plurality of concentric circles 30 allow the light from the first LED 32 to pass through the circles 30 directly to the graphic display 18, unlike conventional lightpipes which do not and must use multiple LEDs to illuminate a display. The plurality of concentric circles 30 may also direct the light to the halo ring 22 to provide further illumination to the halo ring 22. The plurality of concentric circles 30 may have progressively increasing diameters going towards the push button 16 or progressively decreasing diameters going towards the first LED 32. Additionally, more or less concentric circles 30 may be employed. Instead of circles, other structures or surfaces for allowing light to pass through may be employed as well. FIGS. 2A and 2B also show the indicator light 20 and light conduit 24 which will be discussed in more detail below.

Figure 3:
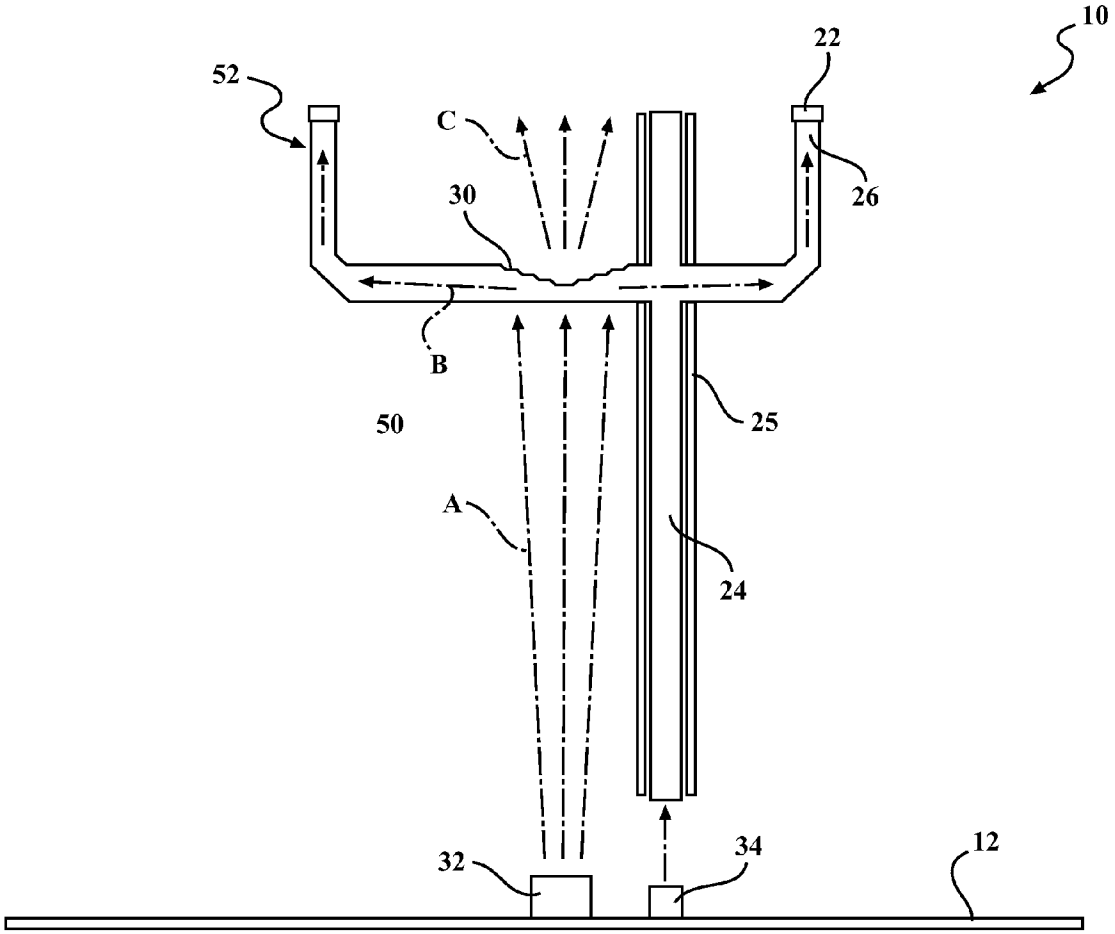
FIG. 3 is a cross-sectional view of a lightpipe within a rotary knob assembly in accordance with an aspect of the disclosure.

With respect to FIG. 3, a cross-sectional view of the lightpipe 26 within the rotary knob assembly 10 in accordance with an aspect of the disclosure is provided. FIG. 3 shows the lightpipe 26 having a middle portion 50 and a peripheral flange 52, the peripheral flange 52 of the lightpipe 26 can engage a halo ring 22 of the assembly 10. FIG. 3 shows the lightpipe 26 having a generally u-shape configuration. The lightpipe 26 may alternatively have a cylindrical shape, a t-shape, a frustoconical shape, or a generally lateral shape. Additionally, the lightpipe 26 may be composed of a plurality of layers of polymeric material, including but not limited to, plastic and optical fiber.

The rotary knob assembly 10 can further include a plurality of concentric circles 30 recessively disposed across the middle portion 50 of the lightpipe 26, the plurality of concentric circles 30 define a central axis 28 of the lightpipe 26 As discussed in FIG. 2, the assembly 10 may further include a first LED 32 affixed to the control panel 12 within the rotary knob portion 14. Additionally, the first LED 32 may be located adjacent to the lightpipe 26. The first LED 32 emits light to the middle portion 50 of the lightpipe 26, denoted by dashed arrows A. The light may be refracted from the middle portion 50 and through the peripheral flange 52 to provide illumination to the halo ring 22, denoted by dashed arrows B. The light may also be distributed from the middle portion 50 through the plurality of concentric circles 30 to provide illumination to a graphic display 18 (not shown) of a push button 16 (not shown) located within the rotary knob assembly 10, denoted by dashed arrows C. Additionally, the plurality of concentric circles 30 may also direct the light to the halo ring 22 to provide further illumination to the halo ring 22.

As shown in FIG. 3, the plurality of concentric circles 30 may have progressively increasing diameters towards the push button 16 (not shown). Alternatively, the plurality of concentric circles 30 may have progressively decreasing diameters towards the first LED 32.

FIG. 3 also shows a light conduit 24 surrounded by a shroud 25 or covering and a second light emitting diode (LED) 34. The light conduit 24 may be in communication with the indicator light 20 of the push button 16. The shroud 25 may encompass the light conduit 24 to prevent light distribution to other components within the rotary knob assembly 10. The light conduit 24 may be situated within the rotary knob portion 14. Additionally, the light conduit 24 may or may not pass through the lightpipe 26 depending on the shape of the lightpipe 26. The second LED 34 may be affixed to the control panel 12 and situated adjacent to the light conduct 24. Specifically, the second LED 34 emits light to the light conduit 24 which provides illumination to the indicator light 20. The second LED 34 may be configured to emit a different color light than the first LED 32.

Figure 4:
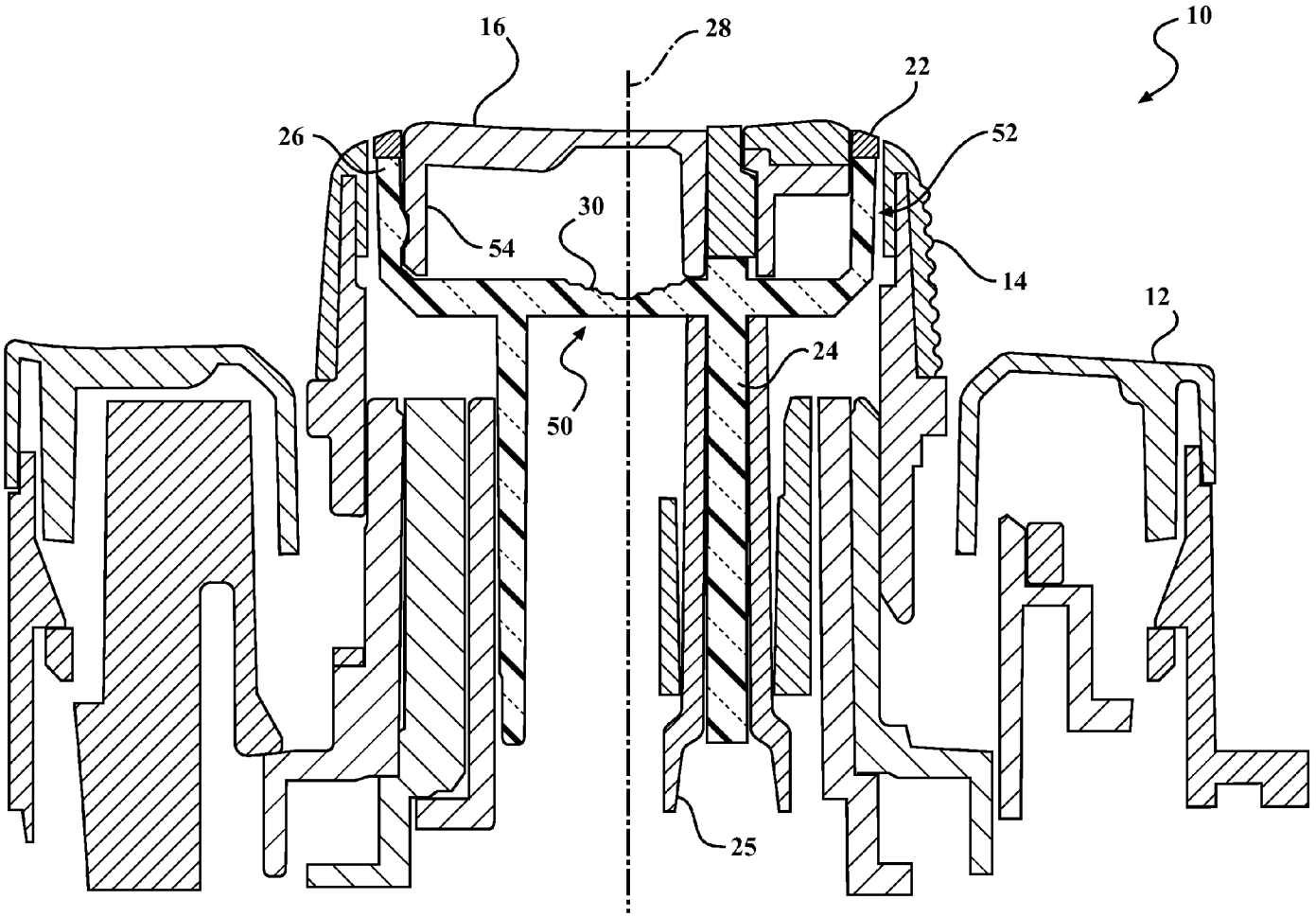
FIG. 4 is another cross-sectional view of the rotary knob assembly in accordance with an aspect of the disclosure.

With respect to FIG. 4, another cross-sectional view of the rotary knob assembly 10 in accordance with an aspect of the disclosure is provided. The rotary knob assembly 10 includes a rotary knob portion 14 rotatably affixed to the vehicle control panel 12. The assembly 10 further includes a push button 16 disposed within the rotary knob portion 14. The push button 16 may have an inner surface and an outer surface. The outer surface may face away from the control panel 12 while the inner surface may face the control panel 10 and may be located within the rotary knob portion 14. In other words, the outer surface may be the portion of the push button 16 displayed by the control panel 12 or the surface the user would see. The push button 16 may be also affixed to the control panel 12. The push button 16 may have a graphic display 18 for alerting the user of a specific setting. Additionally, the push button 16 may have an indicator light 20 for alerting a user when the setting is ON or OFF. A light conduit 24 may be surrounded by a shroud 25 or covering. The light conduit 24 and shroud 25 may be affixed to the indicator light 20 within the push button 16 for the purpose of providing illumination to the indicator light 20. The indicator light 20 may be illuminated when the push button 16 is engaged.

The rotary knob assembly 10 also includes a halo ring 22 surrounding the push button 16. Specifically, the halo ring 22 is radially disposed between the push button 16 and the rotary knob portion 14 within the control panel 12. The rotary knob assembly 10 also includes the lightpipe 26 having an upper portion and a lower portion, the upper portion of the lightpipe 26 having a middle portion 50 and a peripheral flange 52. The peripheral flange 52 of the lightpipe 26 engages a halo ring 22. The lightpipe 26 may have a generally cylindrical shape. The lightpipe 26 may be affixed to the inner surface of the push button 16 within the rotary knob portion 14 of the control panel 12. Specifically, the inner surface of the push button 16 may have a biased portion 54 or peg which engages a groove within the lightpipe 26 and locks the lightpipe 26 into place. Furthermore, the lightpipe 26, the push button 14, and the halo ring 22 remain stationary when the rotary knob portion 14 rotates.

The lightpipe 26 may further include a plurality of concentric circles 30 recessively disposed on the middle portion 50 therein and which define a central axis 28 of the lightpipe 26. As discussed in FIGS. 2 and 3, the plurality of concentric circles 30 may have either progressively increasing diameters or progressively decreasing diameters which assists in directing light to the graphic display 18 of the push button 16. The assembly 10 also includes a first LED 32 affixed to the control panel 12, which provides light to the lightpipe 26. The first LED 32 may be substantially situated away from the lightpipe 26. Specifically, the first LED 32 may emit light to the middle portion 50 of the lightpipe 26. The light may be refracted from the middle portion 50 to the upper portion of the lightpipe 26 and through the peripheral flange 52 to provide illumination to the halo ring 22. The light may also be distributed from the middle portion 50 through the plurality of concentric circles 30 to provide illumination to the graphic display 18 of a push button 16 located within the rotary knob assembly 10. In other words, the recessed portions or gaps between the plurality of concentric circles 30 allow the light from the first LED 32 to pass through the circles 30 directly to illuminate the graphic display 18. The plurality of concentric circles 30 may also direct the light to the halo ring 22 to provide further illumination to the halo ring 22. The LEDs 32, 34 could also be the same color.

The rotary knob assembly 10 may further include a second LED 34 in communication with the control panel 12 within the rotary knob portion 14. The second LED 34 may be adjacent to the first LED 32. The second LED 34 may also be adjacent to the light conduit 24 to illuminate the indicator light 20 of the push button 16. Moreover, the indicator light 20 as well as the halo ring 22 and the graphic display 18 may be illuminated during daytime or nighttime driving utilizing two different color light emitting diodes, one specifically used for the graphic display 18 and the halo ring 22 and another used for the indicator light 20. For example, the first LED 32 may be blue to illuminate both the graphic display 18 and the halo ring 22 while the second LED 34 may be yellow to illuminate the indicator light 24.

As described above, FIGS. 1 to 4 illustrate the rotary knob assembly 10 specifically in regards to a vehicle control panel 12; however, the rotary knob assembly 10 is not limited to only uses within a control panel 12 within an automotive vehicle. A rotary knob assembly 10 having a lightpipe 26 with a plurality of concentric circles 30 and a first light emitting diode 32 has application within household appliances as well as recreational vehicles, recreational appliances, or children's toys. Additionally, the use of a lightpipe 26 having a plurality of concentric surfaces 30 and a first light emitting diode 32 may have application outside of an automotive vehicle, for instance, a smart device may utilize illuminated push buttons. Moreover, the use of a lightpipe 26 having a plurality of concentric surfaces 30 and a first light emitting diode 32 may have application within an automotive vehicle other than within a knob assembly such as, but not limited to, surrounding a liquid crystal diode display or push buttons within a vehicle steering wheel.

While examples of the disclosure have been illustrated and described, it is not intended that these examples illustrate and describe all possible forms of the disclosure. Rather, the words used in the specification are words of description rather than limitation, and it is understand that various changes may be made without departing from the spirit and scope of the disclosure. Additionally, the features and various implementing embodiments may be combined to form further examples of the disclosure.

What is claimed is:

1. A rotary knob assembly for a vehicle control panel, comprising:

a push button having an upper surface with a graphic display therein;

a halo ring disposed peripherally around the push button;

a lightpipe having a middle portion and a peripheral flange, the peripheral flange of the lightpipe engages the halo ring;

a plurality of concentric circles recessively disposed across the middle portion of the lightpipe, the plurality of concentric circles define a central axis of the lightpipe, and a first light emitting diode (LED) adjacent to the lightpipe, the first LED emits light to the middle portion of the lightpipe, wherein a portion of the light is refracted from the middle portion the lightpipe and through the peripheral flange to provide illumination to the halo ring and wherein the light is distributed from the middle portion through the plurality of concentric circles to provide illumination to the graphic display of the push button located within the rotary knob assembly.

2. The rotary knob assembly of claim 1, wherein the plurality of concentric circles direct light to illuminate the halo ring.

3. The rotary knob assembly of claim 1, wherein the plurality of concentric circles have progressively increasing diameters.

4. The rotary knob assembly of claim 1, wherein the rotary knob portion is rotatably affixed to the control panel.

5. The rotary knob assembly of claim 1, wherein the push button and the halo ring remain stationary when the rotary knob portion rotates.

6. The rotary knob assembly of claim 1, wherein the first light emitting diode is disposed within the rotary knob portion and substantially situated away from the lightpipe.

7. The rotary knob assembly of claim 1, wherein the first LED is affixed to the control panel.

8. The rotary knob assembly of claim 3, wherein the push button has an indicator light.

9. The rotary knob assembly of claim 8, further comprising:

a light conduit affixed to the indicator light of the push button within the rotary knob, and a second light emitting diode (LED) disposed within the rotary knob portion, the second light emitting diode is situated adjacent to the light conduit to provide illumination to the indicator light.

10. A rotary knob assembly for a vehicle control panel, comprising:

a push button having an outer surface and inner surface, the push button disposed within a rotary knob portion on the vehicle control panel;

a halo ring disposed peripherally around the push button; and a lightpipe having a middle portion and a peripheral flange, the peripheral flange of the lightpipe engages the halo ring, the middle portion of the lightpipe is affixed to the inner surface of the push button, wherein the push button, the lightpipe, and the halo ring remain stationary when the rotary knob portion rotates.

11. The rotary knob assembly of claim 10, further comprising:

a plurality of concentric circles recessively disposed across the middle portion of the lightpipe, the plurality of concentric circles define a central axis of the lightpipe.

12. The rotary knob assembly of claim 10, further comprising:

a first light emitting diode (LED) adjacent to the lightpipe, the first LED emits light to the middle portion of the lightpipe.

13. The rotary knob assembly of claim 12, wherein the light from the first LED is refracted from the middle portion of the lightpipe and through the peripheral flange to provide illumination to the halo ring and wherein the light is distributed from the middle portion through the plurality of concentric circles to provide illumination to a graphic display of a push button located within the rotary knob assembly.

14. The rotary knob assembly of claim 11, wherein the plurality of concentric circles have progressively increasing diameters.

15. A rotary knob assembly for a vehicle control panel, comprising:

a rotary knob portion rotatably affixed to the control panel;

a push button having an outer surface, an inner surface, and a graphic display, the push button disposed within the rotary knob portion;

a halo ring surrounding the push button and radially disposed between the push button and the rotary knob portion;

a lightpipe having a middle portion and a peripheral flange, the peripheral flange of the lightpipe engages the halo ring and the middle portion of the lightpipe is affixed to the inner surface of the push button;

a plurality of concentric circles recessively disposed across the middle portion of the lightpipe, the plurality of concentric circles define a central axis of the lightpipe; and a first light emitting diode (LED) adjacent to the lightpipe, the first LED emits light to the middle portion of the lightpipe, wherein the light is refracted from the middle portion of the lightpipe and through the peripheral flange to provide illumination to the halo ring and wherein the light is distributed from the middle portion through the plurality of concentric circles to provide illumination to a graphic display of a push button located within the rotary knob assembly.

16. The rotary knob assembly of claim 15, wherein the plurality of concentric circles direct light to illuminate the halo ring.

17. The rotary knob assembly of claim 15, wherein the first LED is disposed within the rotary knob portion and is substantially situated away from the lightpipe.

18. The rotary knob assembly of claim 15, wherein the push button, the halo ring, and lightpipe remain stationary when the rotary knob portion rotates.

19. The rotary knob assembly of claim 15, wherein the push button has an indicator light.

20. The rotary knob assembly of claim 19, further comprising:

a light conduit affixed to the indicator light within the push button; and a second light emitting diode disposed within the rotary knob assembly and is situated adjacent to the light conduit to provide illumination to the indicator light.

* * * * *